US006661332B1

(12) United States Patent
Hsu

(10) Patent No.: US 6,661,332 B1
(45) Date of Patent: Dec. 9, 2003

(54) PRESS-TYPE VARISTOR SWITCH

(76) Inventor: Wei Hsu, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/383,334

(22) Filed: Mar. 10, 2003

(51) Int. Cl.[7] ..... H01K 10/06

(52) U.S. Cl. ..... 338/21; 338/47; 338/92; 338/96; 338/99

(58) Field of Search ..... 338/47, 20, 21, 338/92, 96, 97, 99, 114

(56) References Cited

U.S. PATENT DOCUMENTS 4,847,586 A * 7/1989 Tanaga et al. ..... 338/114
5,231,386 A * 7/1993 Brandenburg et al. ..... 345/174
6,275,138 B1 * 8/2001 Maeda ..... 338/47
6,344,791 B1 * 2/2002 Armstrong ..... 338/114
6,437,682 B1 * 8/2002 Vance ..... 338/185
6,531,951 B2 * 3/2003 Serban et al. ..... 338/47
6,563,415 B2 * 5/2003 Armstrong ..... 338/47

* cited by examiner

*Primary Examiner*—Karl D. Easthom

(57) ABSTRACT

A press-type varistor switch is disclosed. A center of an upper cover is formed with a round hole. A head of a silicide cap is embedded into the round hole. Opposite sides of the seat are formed with a metal guide pin. The head of the silicide cap protrudes from a round hole of the upper cover so that the silicide cap is enclosed between the upper cover and the seat. Each of the adjacent sides of the metal guide pins are extended with a carbon-film resistor; and the two carbon-film resistors are not in contact to one another. An interior of the head is installed with a conductive rubber. The conductive rubber is above the two carbon-film resistors. When a force is applied to the silicide cap, the two carbon-film resistors are in contact with the two metal guide pins partially or fully so that the impedance is adjustable.

2 Claims, 9 Drawing Sheets

PRESS-TYPE VARISTOR SWITCH

FIELD OF THE INVENTION

The present invention relates to switches, and particularly to a press-type varistor switch with adjustable impedance so that the switch can be operated in various operation modes.

BACKGROUND OF THE INVENTION

Conventionally, a switch is operated at two status, one being fully turning-on and the other being full turn-off. Referring to FIGS. 8 to 10, the cross section views of some prior art switches are presented. These prior art switches are operated at two states, i.e., fully open and fully close. FIG. 9 and 10 shows the operation of one prior art switch. It is illustrated these kinds of switches are operated only at two modes. However recently, the electronic products are made more and more complex, and thus they need some operation modes other than full turning-on or turning off. That is, a switching state between full turning-on and turning-off is necessary, for example to press a switch continuously or to press a switch twice, or to press a switch for a predetermined time period so as to execute a desired operation, etc. However many prior art designs have complex structures and thus the costs are high.

Thereby, there is an eager demand for a novel switch which can improve above flaws in the prior art.

SUMMARY OF THE INVENTION

Accordingly, the primary object of the present invention is to provide a press-type varistor switch. A center of a upper cover is formed with a round hole. A head of a silicide cap is embedded into the round hole. Opposite sides of the seat are formed with a metal guide pin. The head of the silicide cap protrudes from a round hole of the upper cover so that the silicide cap is enclosed between the upper cover and the seat. Each to the adjacent sides of the metal guide pins is extended with a carbon-film resistor; the two carbon-film resistors are not in contact to one another. An interior of the head is installed with a conductive rubber. The conductive rubber is above the two carbon-film resistor. When a force is applied to the silicide cap, the two carbon-film resistors are in contact with the two metal guide pins partially or fully so that the impedance is adjustable.

The various objects and advantages of the present invention will be more readily understood from the following detailed description when read in conjunction with the appended drawing.

DETAILED DESCRIPTION OF THE PREFERRED EMBODIMENTS

Figure 1:
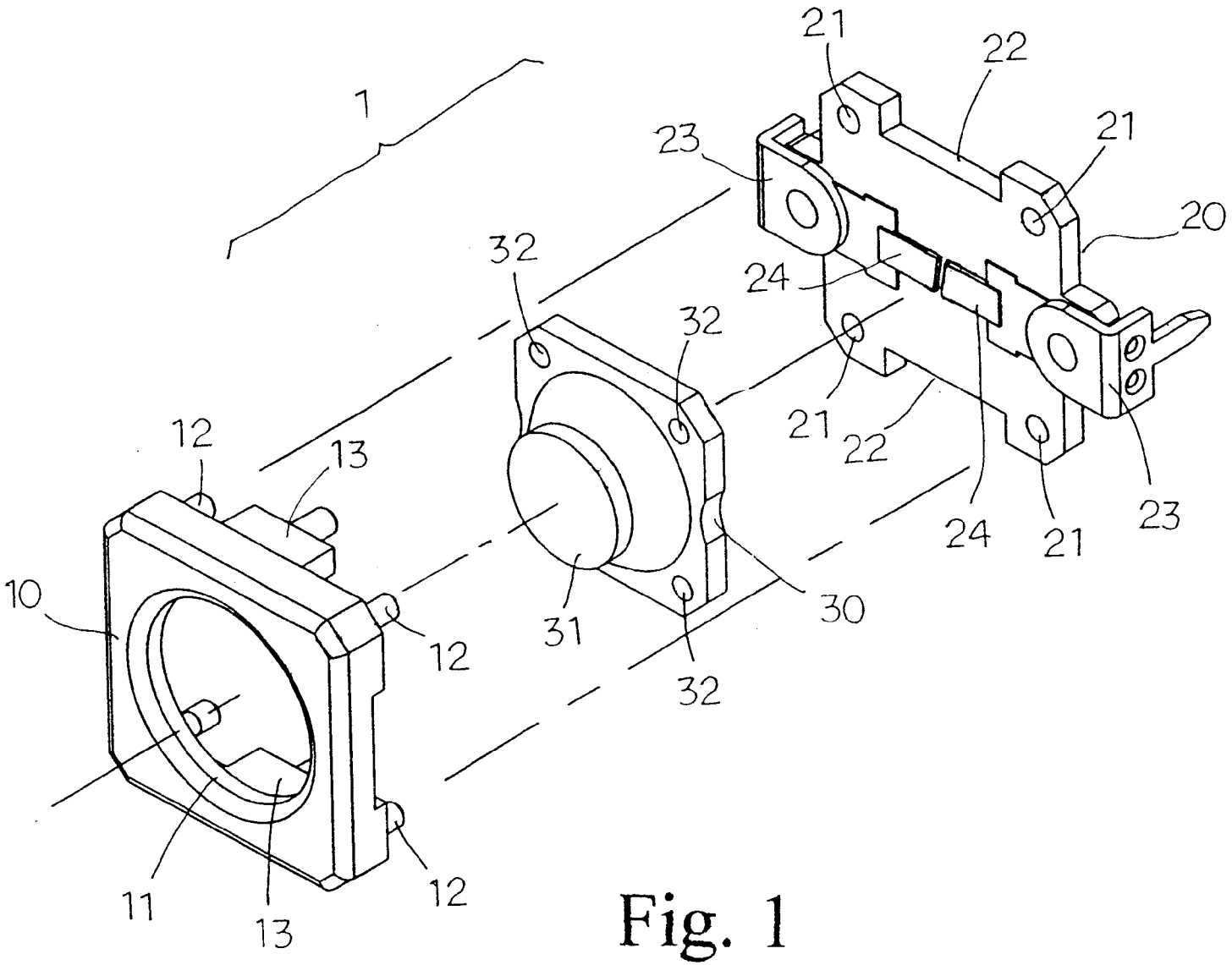
FIG. 1 is an exploded view of a preferred embodiment of the present invention.
Figure 2:
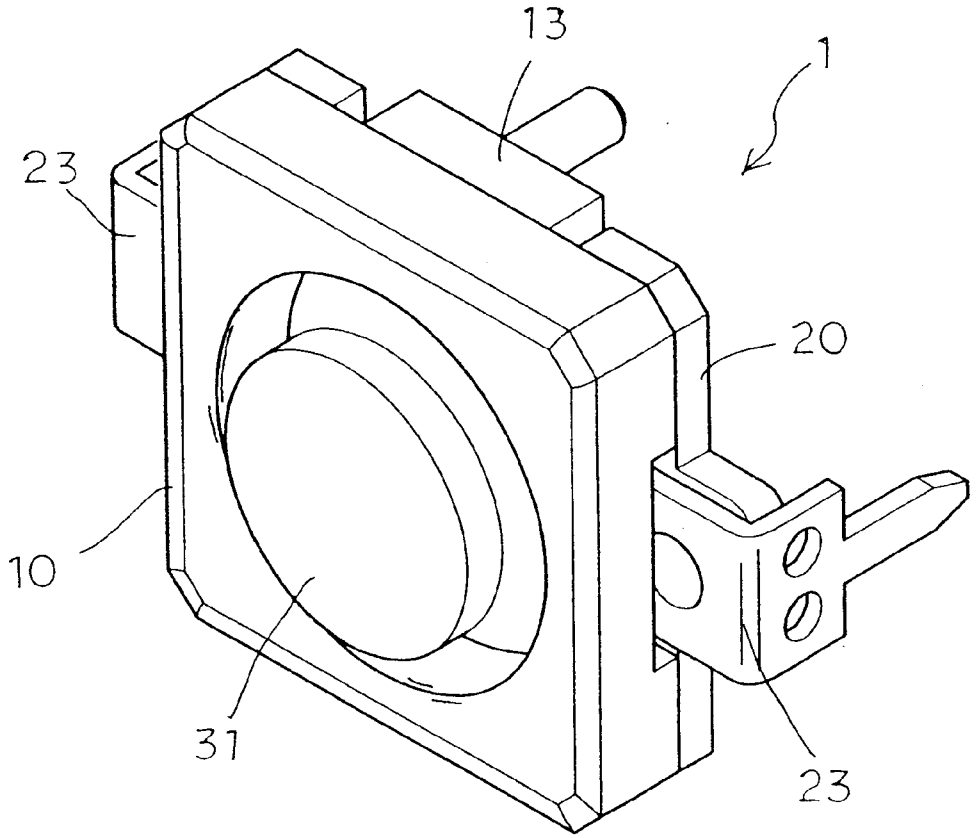
FIG. 2 is an assembled view of FIG. 1.

Referring to FIGS. 1 and 2, the press-type varistor switch of the present invention is illustrated. In the present invention, the switch 1 is formed by an upper cover 10, a seat 20, and a silicide cap 30 installed between the upper cover 10 and the seat 20. A center of the upper cover 10 is formed with a round hole 11. A head 31 of the silicide cap 30 is embedded into the round hole 11. The corners of the bottom of the upper cover 10 are formed with a plurality of posts 12. Each side of a pair of opposite sides of the bottom of the upper cover 10 is installed with a buckling block 13.

The seat 20 is designed to have the configuration matching the upper cover 10. The corners of the seat 20 are formed with combining holes 21. The posts 12 of the upper cover 10 are inserted into the combining holes 21 of the seat 20. Each side of a pair of opposite sides of the seat 20 is formed with a recess 22 for receiving the buckling block 13. Each side of another set of opposite sides is formed with a metal guide pin 23. Each to the adjacent sides of the metal guide pins 23 is extended with a carbon-film resistor 24. The two carbon-film resistors 24 are not in contact to one another.

The silicide cap 30 has a trumpet shape. The head 31 of the silicide cap 30 protrudes from a round hole 11 of the upper cover 10 so that the silicide cap 30 is enclosed between the upper cover 10 and the seat 20 and thus is positioned therein. An interior of the head 31 is installed with a conductive rubber 33 with a round cross section view. When a force is applied to the silicide cap 30 to force the head 31 to the move downward, the conductive rubber 33 can be as an electric medium for communicating the two metal guide pins 23.

Based on above said construction, in assembly, the silicide cap 30, upper cover 10 and seat 20 are assembled sequentially. At first, the seat 20 of the silicide cap 30 is embedded into the round hole of the upper cover 10. Furthermore, the posts 12 at the periphery of the upper cover 10 are embedded into the combining holes 21 corresponding to the seat 20 for being positioned therein.

Figure 3:
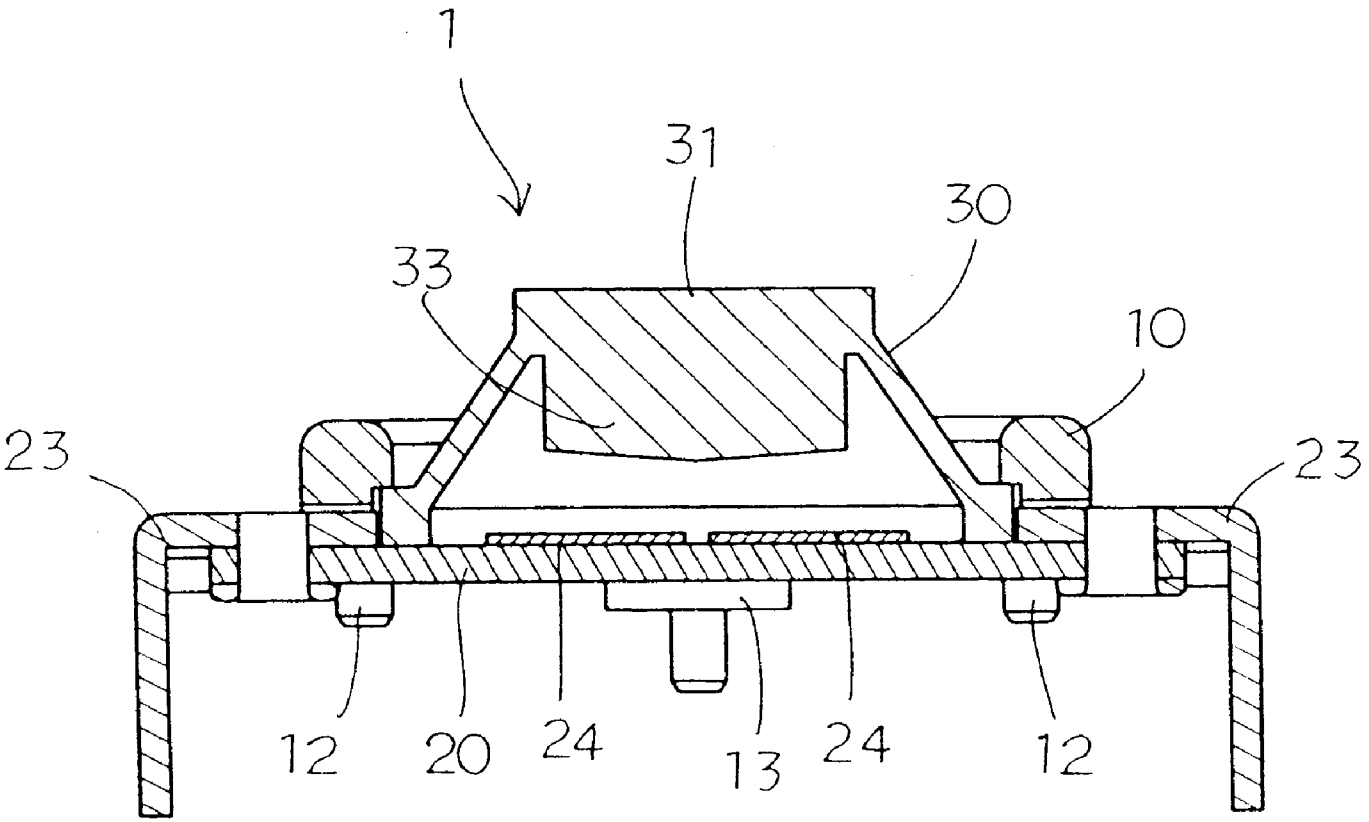
FIG. 3 is a cross section view of FIG. 1.

Referring to FIG. 2, in realizing the present invention, as shown in FIG. 3, when no force is applied to the silicide cap 30, the conductive rubber 33 is suspended in the inner surface of the head 31 and is not in contact with the seat 20. At this time, the carbon-film resistors 24 between the two metal guide pins 23 at the surface of the seat 20 have higher impedance, i.e., they are not conductive. When an external force is applied to the silicide cap 30, the head is pressed downwards so that a center of the round conductive rubber 33 will contact the two carbon-film resistors 24. Then the current flowing through one metal guide pin 23 will flow through one carbon-film resistor 24 to the other carbon-film resistor 24 and then to the other metal guide pin 23 so that a lower impedance electric loop is formed. If the force applied to the silicide cap 30 is increased continuously, it will induce that the contact area between the conductive rubber 33 and the carbon-film resistor 24 is increased. Thereby, the current from one metal guide pin 23 to the other metal guide pin 23 through the two carbon-film resistors 24 and the conductive rubber 33 will increase so that the impedance of the loop is reduced. Finally, when the force applied is increased to a predetermined range, the cambered surface of the conductive rubber 33 will cover the two carbon-film resistors 24 completely and touch the two metal guide pins 23. Then the current will flow from one metal guide pin 23 to another metal guide pin 23 through the conductive rubber 33 directly. This is the same as the conduction of a conventional push button.

Therefore, the present invention has the feature of complete conduction or turning-off as a conventional switch and has the function of variation of impedance with the external force. Functionally, the present invention is superior that the prior art switch.

Figure 4:
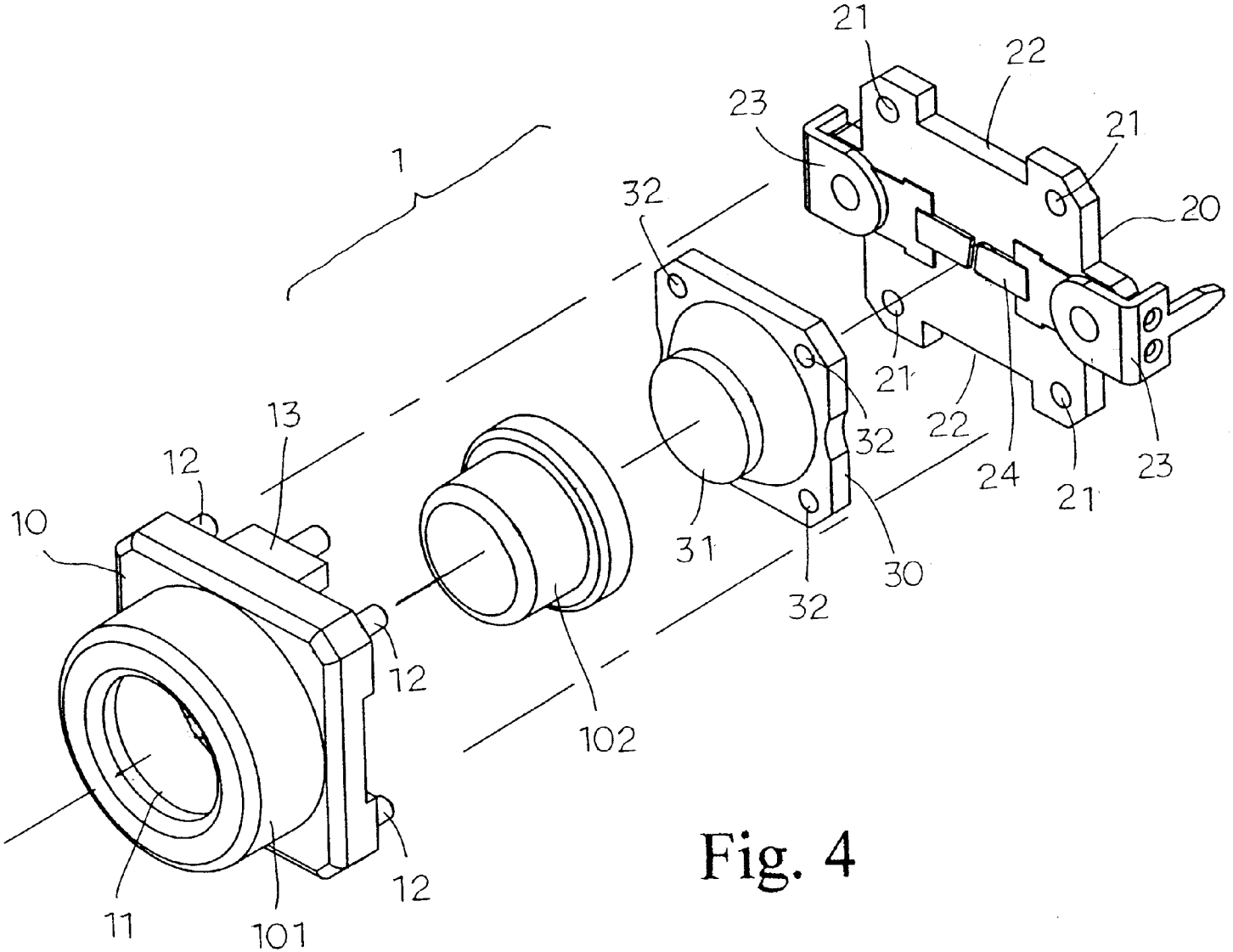
FIG. 4 is an exploded view of a second embodiment of the present invention.
Figure 5:
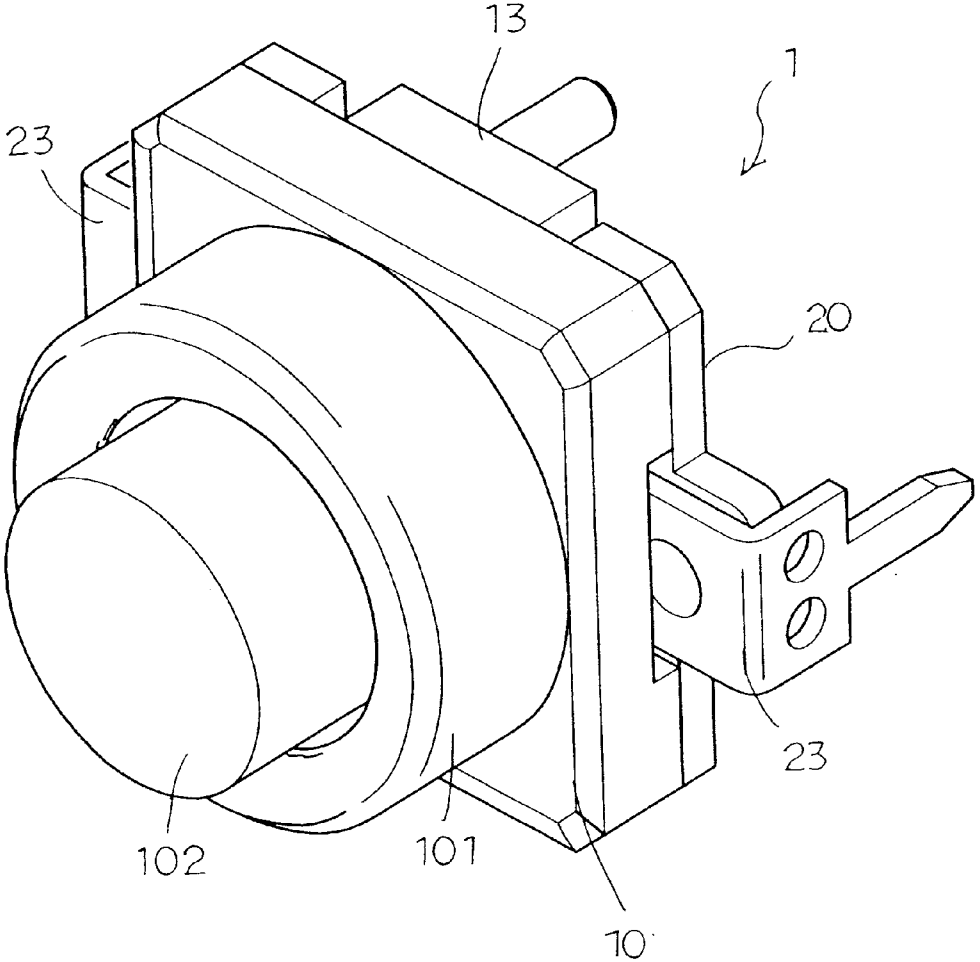
FIG. 5 is an assembled view of FIG. 4.
Figure 6:
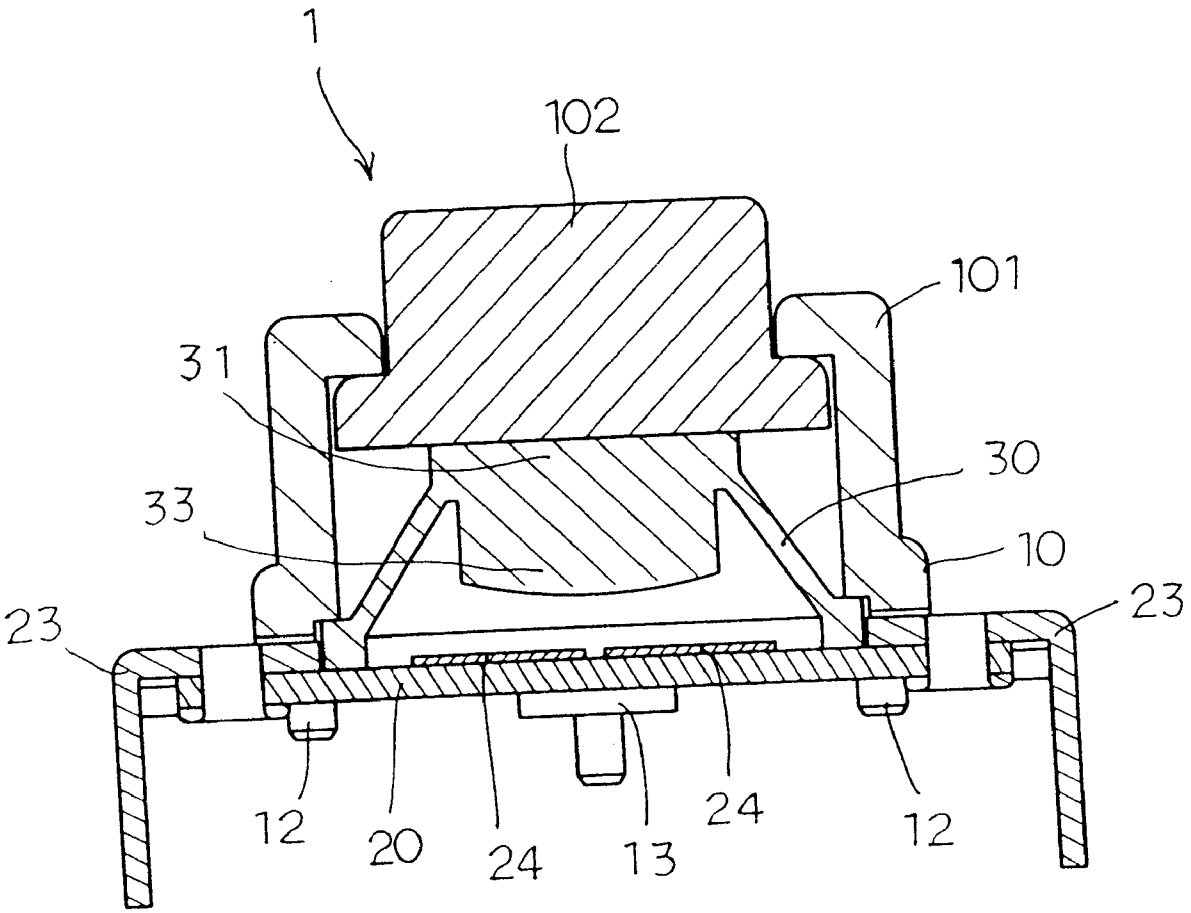
FIG. 6 is a cross section view about the device shown in FIG. 4.
Figure 7:
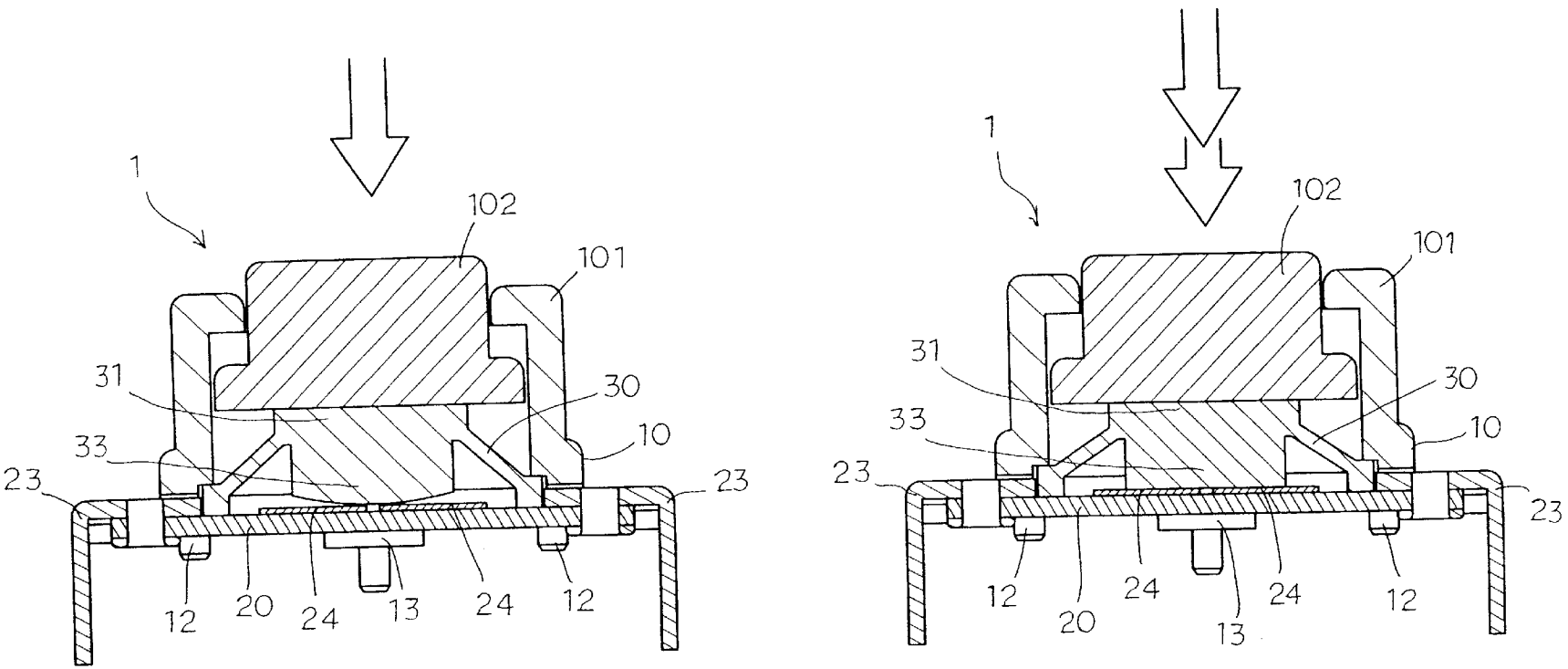
FIG. 7 is a schematic view showing the operation of the embodiment shown in FIG. 4.
Figure 8:
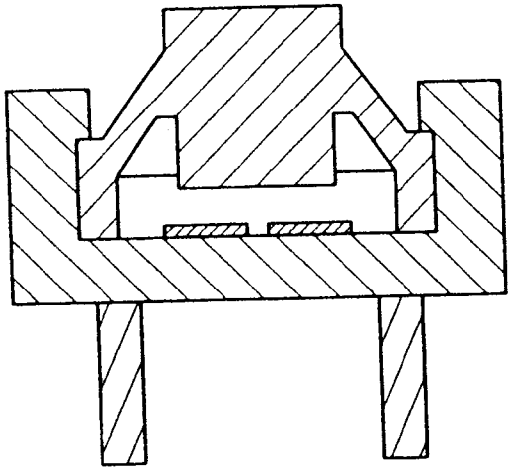
FIG. 8 is a cross section view of a prior art switch.
Figure 9:
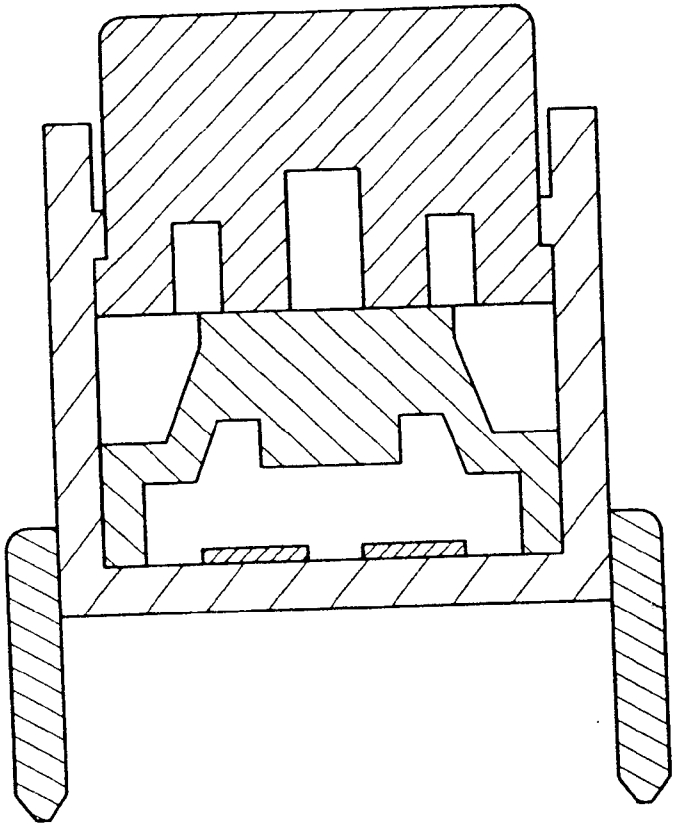
FIG. 9 is a cross section view of another prior art switch.
Figure 10:
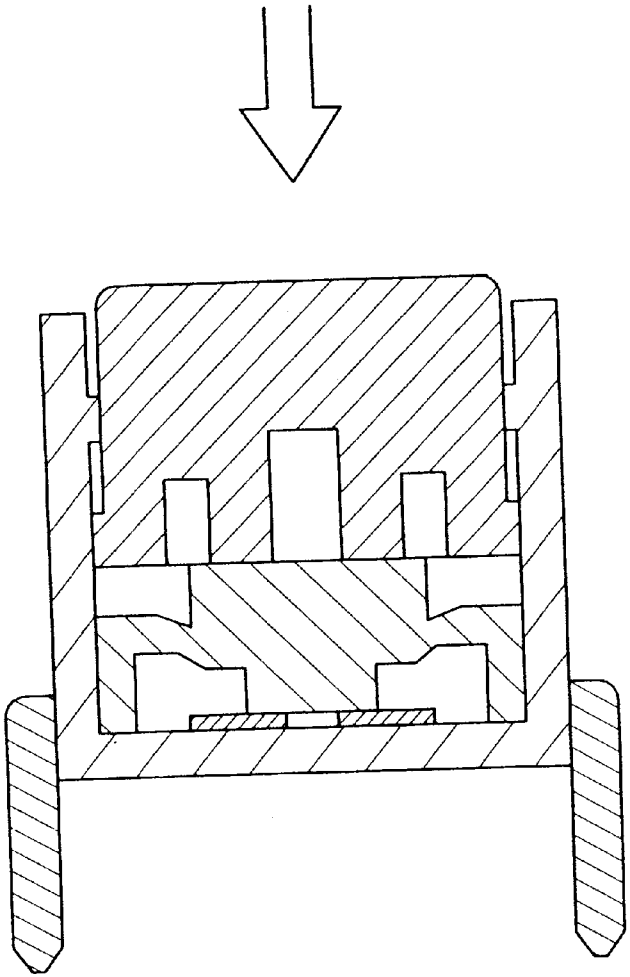
FIG. 10 is a schematic view showing the operation of the switch shown in FIG. 9.

Referring to FIGS. 4 to 7, another embodiment about the press-type varistor switch of the present invention is illustrated. As shown in FIG. 4, a periphery of the round hole 11 at the center of the upper cover 10 is formed with an annular edge 101. A press cover 102 is embedded in the round hole. Interior of the press cover 102 serves for being embedded by the head 31 of the silicide cap 30. In the present invention, other structures, such as seat 20 and silicide cap 30 are the same as those describe above. Thereby, after assembly, as shown in FIGS. 5 and 6, when external force is applied to the press cover 102 continuously, the head 31 and conductive rubber 33 therewithin can be pressed at the same time so as to partially or wholly contact the two carbon-film resistors 24, even to touch the two metal guide pins 23. Thus, the impedance will be varied with the applied force, as shown in FIG. 7.

Thereby, in the present invention, a conductive rubber 33 is installed at the inner surface of the silicide cap 30 and is suspended above two opposite but non-contact carbon-film resistors 24. The rear ends of the two carbon-film resistors 24 are connected with respective metal guide pins so as to form a switch module. In operation, other than the full turning-on and full turning-off operations, the impedance between the two metal guide pins are varied with the force applied to the silicide cap.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A press-type varistor switch comprising an upper cover, a seat, and a silicide cap installed between the upper cover and the seat; wherein a center of the upper cover is formed with a round hole; a head of the silicide cap is embedded into the round hole; corners of a bottom of the upper cover are formed with a plurality of posts; each side of opposite sides of the bottom of the upper cover is installed with a buckling block;

corners of the seat are formed with combining holes; the posts of the upper cover are inserted into the combining holes of the seat; each side of a pair of opposite sides of the seat is formed with recess for receiving the buckling block; each side of another opposite sides of the seat is formed with a metal guide pin;

the silicide cap has a trumpet shape; the head of the silicide cap protrudes from a round hole of the upper cover so that the silicide cap is enclosed between the upper cover and the seat, and thus is positioned therein; characterized in that:

each of the adjacent sides of the metal guide pins is extended with a carbon-film resistor; the two carbon-film resistors are not in contact to one another; an interior of the head is installed with a conductive rubber with a round cross section; the conductive rubber is above the two carbon-film resistor;

when a force is applied to the silicide cap to force the head to the move downward so that the conductive rubber is as an electric medium for communicating the two metal guide pins; when the applied force is applied to the head continuously, the conductive rubber therein can be pressed continuously so that the two carbon-film resistors are in contact with the two metal guide pins partially or fully, and thus the impedance of the two metal guide pins are adjustable.

2. The press-type varistor switch as claimed in claim 1, wherein a periphery of the round hole at the center of the upper cover is formed with an annular edge; a press cover is embedded in the round hole so that the upper cover, the silicide cap and the seat are formed as a press-type varistor switch.

* * * * *